US007734215B2

(12) United States Patent
Ohanyan

(10) Patent No.: US 7,734,215 B2
(45) Date of Patent: Jun. 8, 2010

(54) CARTRIDGE DRUM ROLLER

(75) Inventor: Tigran Ohanyan, Burbank, CA (US)

(73) Assignee: Future Graphics Imaging Corporation, San Fernando, CA (US)

( * ) Notice: Subject to any disclaimer, the term of this patent is extended or adjusted under 35 U.S.C. 154(b) by 404 days.

(21) Appl. No.: 11/725,862

(22) Filed: Mar. 21, 2007

(65) Prior Publication Data

US 2008/0232845 A1 Sep. 25, 2008

(51) Int. Cl.
*G03G 15/00* (2006.01)

(52) U.S. Cl. ..... 399/109; 399/126; 29/240

(58) Field of Classification Search ..... 399/109, 399/126; 29/240, 270, 278, 895.1
See application file for complete search history.

(56) References Cited

U.S. PATENT DOCUMENTS

| | | | | |
|---|---|---|---|---|
| 4,076,410 | A * | 2/1978 | Kono et al. | 399/161 |
| 5,132,728 | A * | 7/1992 | Suzaki et al. | 399/167 |
| 5,381,213 | A * | 1/1995 | Michlin | 399/109 |
| 2002/0028087 | A1 * | 3/2002 | Higeta et al. | 399/109 |

* cited by examiner

*Primary Examiner*—David P Porta
*Assistant Examiner*—Benjamin Schmitt

(57) ABSTRACT

A tool for rotating a drum from a first cartridge drum axle end, the first cartridge drum axle end having a predetermined shape, the tool comprising a tool body configured to provide structure to the tool; a first end defined by the tool body; a second end defined by the tool body, the second end positioned on an end on the tool body opposite to the first end; and a first impression made on the first end of the tool body, the first impression substantially matching the predetermined shape of the first cartridge drum axle end, wherein when the first cartridge drum axle end is inserted within the first impression, the tool allows the drum to be rotated.

7 Claims, 4 Drawing Sheets

CARTRIDGE DRUM ROLLER

CROSS REFERENCES TO RELATED APPLICATIONS

None

FIELD OF INVENTION

The present invention relates to electrophotography, particularly methods and apparatus for manufacturing and remanufacturing toner cartridges.

BACKGROUND

Printer cartridges typically include a cartridge drum. The cartridge drum is usually electrically charged and functions to transfer toner to paper according to a print pattern. The cartridge drum is usually mounted to a printer cartridge via a drum axle assembly 10 (FIG. 1). The drum axle assembly includes a drum axle end 12, which may be of various shapes and sizes. In some printer cartridges, the drum axle end 12 may be made of either plastic or metal and may have a substantially triangular shape (FIGS. 1-3).

Printer cartridges of fax machines, copiers, inkjet printers, and laser printers are often remanufactured. The remanufacturing of printer cartridges may include cleaning, repairing damaged parts, adding toner, and replacing worn parts. Among the parts being replaced is the drum. When the drum is attached to the cartridge either during manufacturing or remanufacturing, the drum gets lubricated and the tightness of the drum attachment to the printer cartridge is checked. During the lubrication and the tightness check, the drum has to be rotated a few times by turning the drum axle from the drum axle end.

Currently, the drum may be rotated by hand during lubrication and tightness check. The problem with this method is that it may be ineffective in high volume manufacturing and remanufacturing environment. A method and device that would provide leverage in rotating the drum during cartridge manufacturing or remanufacturing are desired and are addressed by the present invention.

BRIEF DESCRIPTION OF THE PREFERRED EMBODIMENTS OF THE PRESENT INVENTION

The present invention includes a tool for rotating a drum from a first cartridge drum axle end, the first cartridge drum axle end having a predetermined shape, the tool comprising a tool body configured to provide structure to the tool; a first end defined by the tool body; a second end defined by the tool body, the second end positioned on an end on the tool body opposite to the first end; and a first impression made on the first end of the tool body, the first impression substantially matching the predetermined shape of the first cartridge drum axle end, wherein when the first cartridge drum axle end is inserted within the first impression, the tool allows the drum to be rotated.

The present invention also includes a method of assembling a printer cartridge drum, the printer cartridge drum having an axle connected to a printer drum driving mechanism, the axle being connected to the printer at an axle end, the method comprising providing a tool configured to hold the axle end; allowing the tool to hold the axle end; and rotating the tool to rotate the drum.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

Figure 4:
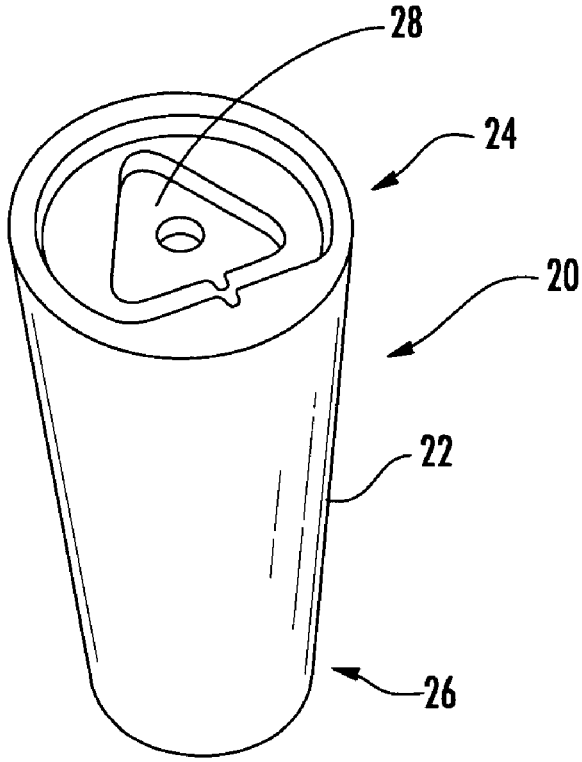
FIG. 4 is substantially a front elevational view of a cartridge drum tool of the present invention and particularly showing a first end.

Referring now to FIG. 4, the present invention includes various embodiments of a tool 20 that may be used for rotating drums of printer cartridges. The tool 20 preferably includes a body 22, which may be cylindrical in shape. The body 22 preferably defines the structure of the tool 20 and may serve as a tool handle. The body 22 may be made of known materials, such as glass or acrylic and may include various shapes. The body 22 may further be modified to enhance the user's ability to grip it.

The body 22 preferably defines a first end 24 and a second end 26 preferably located at opposite ends of the body 22. A shape of a cartridge drum axle end is preferably impressed on the first end 24. The first impression 28 is preferably of a depth that would allow the tool 20 to promote torque when the cartridge drum axle end is inserted within the first impression 28 on the first end 24. The first impression 28 may be made by various cutting tools known in the art.

Figure 5:
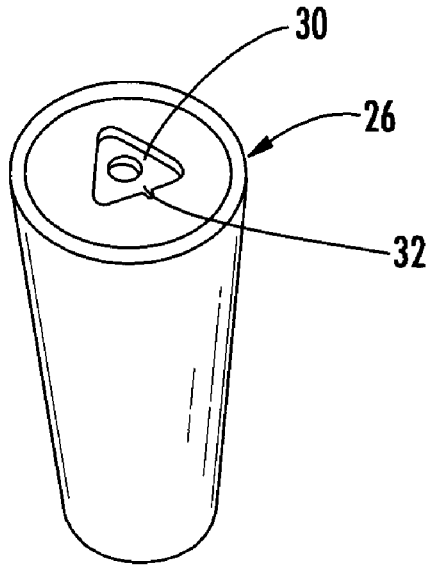
FIG. 5 is substantially a front elevational view of a cartridge drum tool of the present invention and particularly showing a second end.
Figure 7:
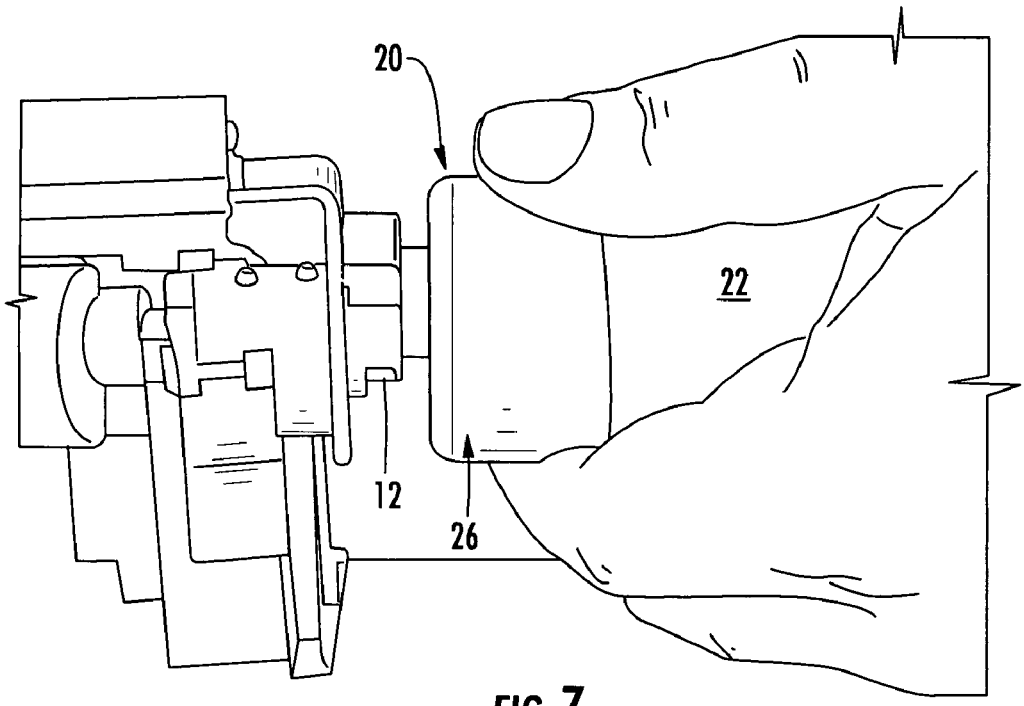
FIG. 7 is substantially a front view of the cartridge drum tool being used to rotate a drum from a drum axle end.

Referring now to FIG. 5, another shape of a cartridge drum axle end is preferably impressed on the second end 26. Again, the second impression 30 is preferably of a depth that would allow the tool 20 to promote torque when the cartridge drum axle end is inserted within the second impression 30 on the second end 26. The second impression 30 may also be made by cutting tools known in the art.

Figure 1:
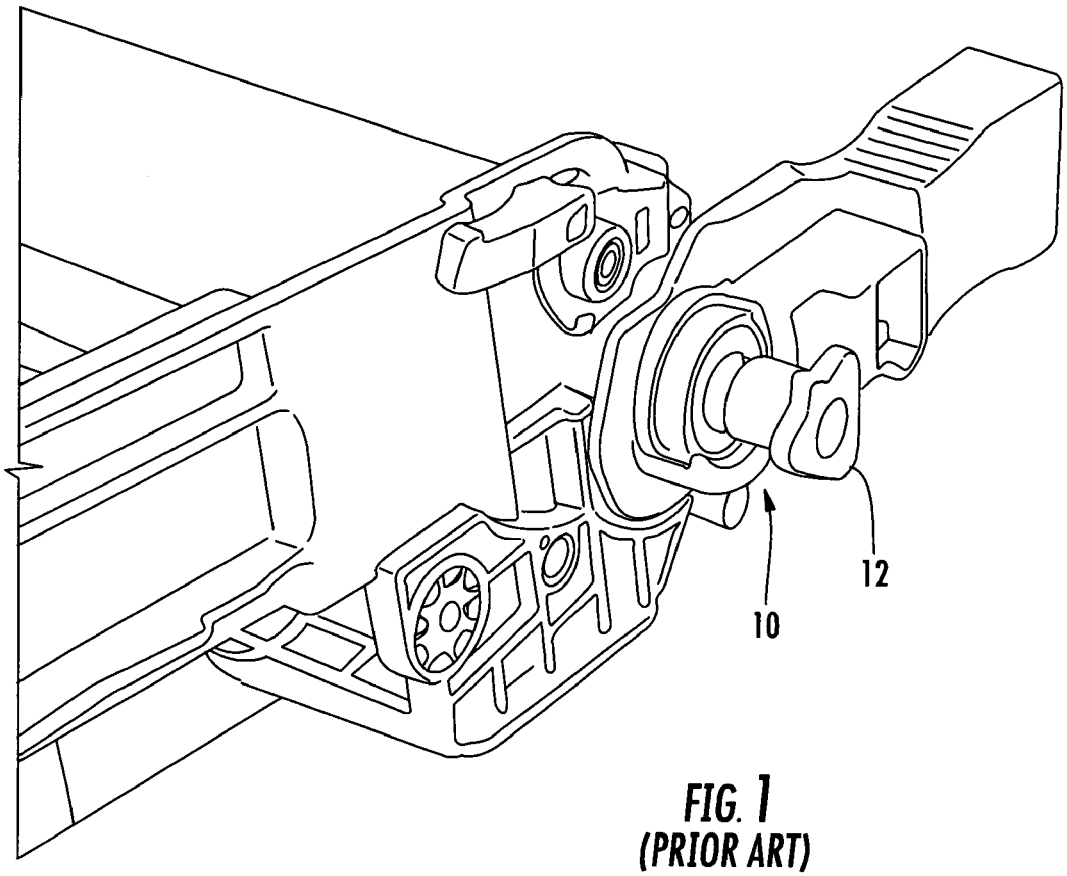
FIG. 1 (PRIOR ART)
FIG. 1 is substantially a perspective view of a drum axle end of a prior art printer cartridge.
Figure 2:
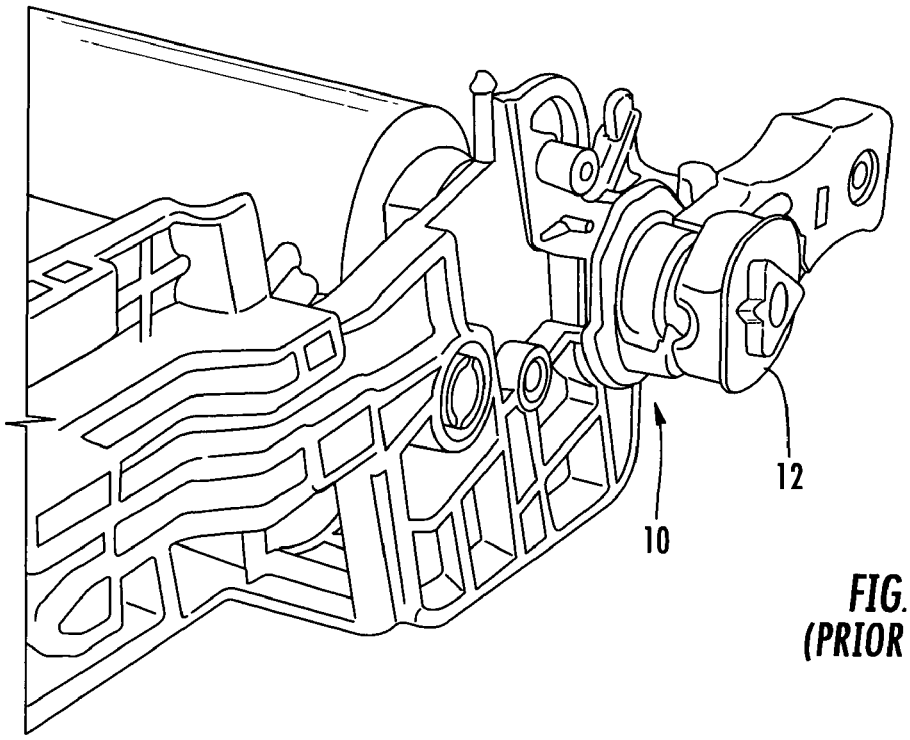
FIG. 2 (PRIOR ART)
FIG. 2 is substantially a perspective view of another drum axle end of a prior art printer cartridge.
Figure 3:
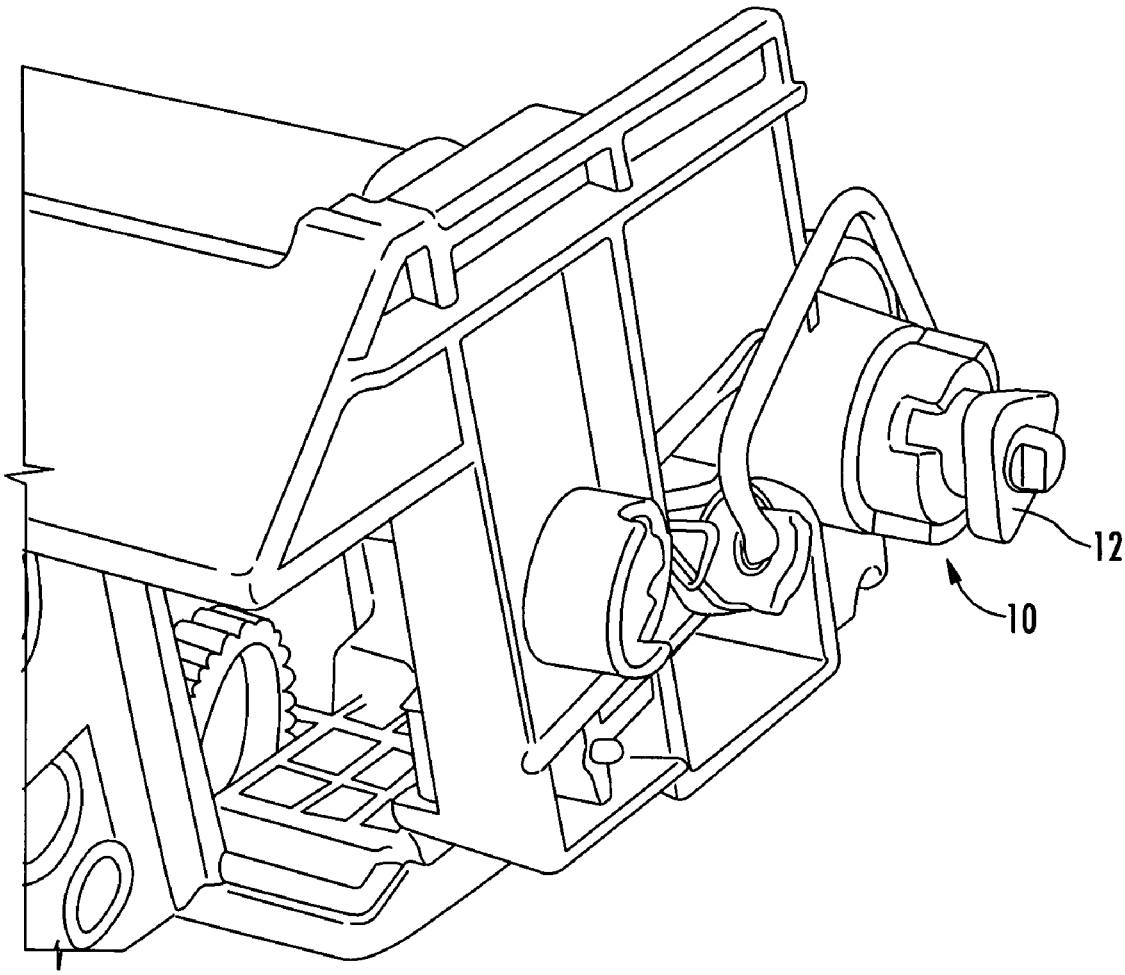
FIG. 3 (PRIOR ART)
FIG. 3 is substantially a perspective view of yet another drum axle end of a prior art printer cartridge.

In the example shown in FIG. 4, it is noted that the first impression 28 preferably includes a triangular shape with a circle in the middle of the triangle. It can be appreciated that the first impression 28 may be designed for use with drum axle ends, such as those shown in FIGS. 2 and 3. In the example shown in FIG. 5, it is noted that the second impression 30 preferably includes a triangular shape with a circle substantially in the middle of the triangle and a tail 32 on the bottom of the triangle. It can be appreciated that the second impression 30 may be designed for use with a drum axle end, such as the one shown in FIG. 1. It can then be realized that the designs of the impressions on the ends of the tool 20 may vary depending on the shapes or designs of the drum axle ends for which the tool 20 is intended to be used.

Manner of Use

Figure 6:
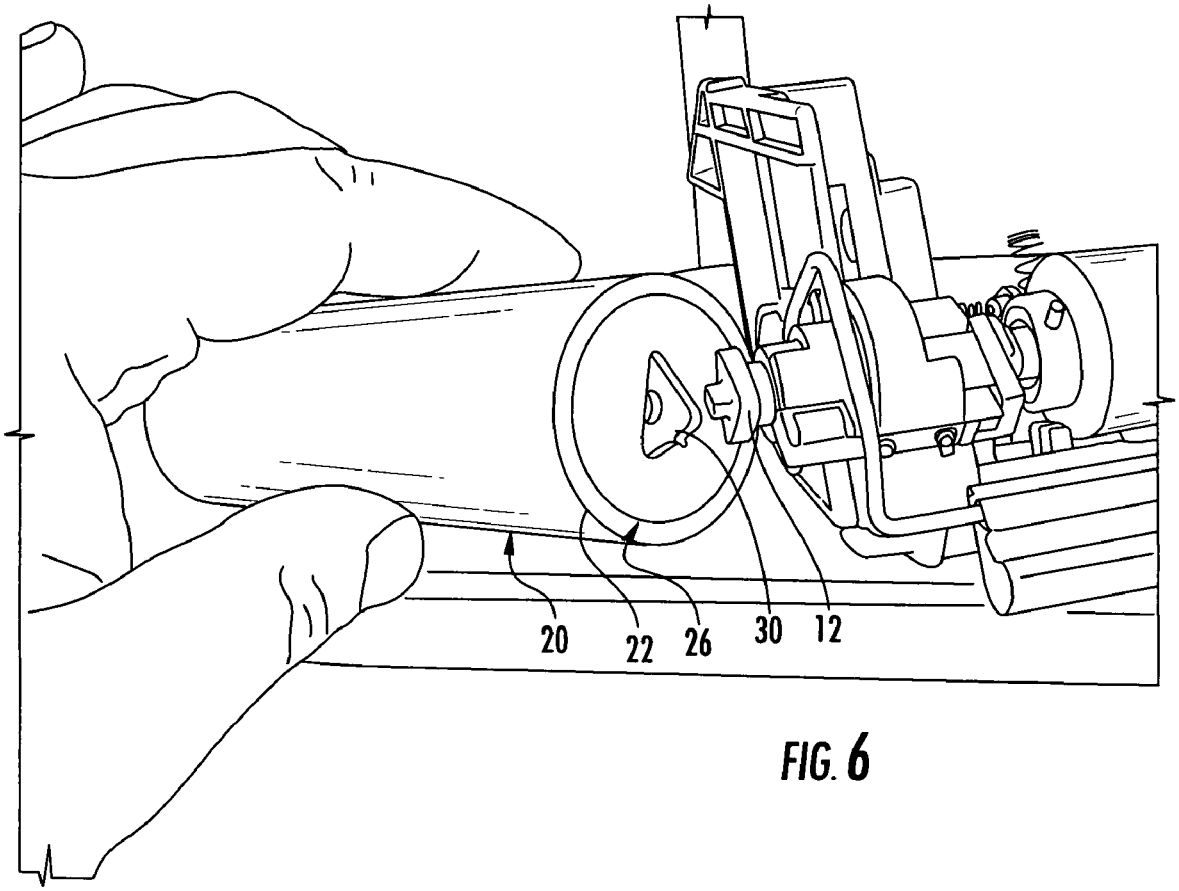
FIG. 6 is substantially a front view of the cartridge drum tool about to be attached to a drum axle end.

With reference now to FIG. 6, the tool 20 may be used as follows. The tool body 22 may be held by a user. The tool body 22 may be positioned proximate to a drum axle end 12, and the drum axle end 12 may be positioned within the first or second impression 28, 30 of the tool 20. The tool 20 may be pushed against the drum axle end 12 to allow the tool 20 to provide the most leverage. The edges of the drum axle end 12 preferably abut the edges of the first or second impression 28, 30 thereby allowing the tool 20 to rotate the drum axle via the drum axle end 12.

It can now be realized that the present invention provides an efficient tool for rolling the drum during manufacturing or remanufacturing of printer cartridges. The tool may be used when rolling the drum to apply known drum lubricants during manufacturing or remanufacturing of printer cartridges. The tool may further be used to roll the drum to test the proper rotation and tightness of the drum.

It can be appreciated that tool may be ideal for high production environments, as the manufacturers or remanufacturers may not have to use their hands directly to rotate the cartridge drum axle end. The tool may provide them with readily available torque to rotate the cartridge drum axle end. Finally, it can be appreciated that the tool is simple to use and may be simple and inexpensive to manufacture.

Although the description above contains many specifications, these should not be construed as limiting the scope of the invention but as merely providing illustrations of some of the presently preferred embodiments of this invention. For example, the size and shape of the tool body 22 may vary. The invention is capable of other embodiments and of being practiced and carried out in various ways. The invention is not limited in its application to the details of the construction and to the arrangement of the components set forth in the above description or as illustrated in the drawings.

What is claimed is:

1. A tool for rotating a drum from a first cartridge drum axle end, the first cartridge drum axle end having a predetermined shape, the drum being housed in a printer and the tool being separate from the printer and not being housed in the printer, the tool comprising:

a. a tool body configured to provide structure to the tool;

b. a first end defined by the tool body;

c. a second end defined by the tool body, the second end positioned on an end on the tool body opposite to the first end;

d. a first impression made on the first end of the tool body, the first impression substantially matching the predetermined shape of the first cartridge drum axle end, wherein when the first cartridge drum axle end is inserted within the first impression, the tool allows the drum to be rotated while the drum is within a printer cartridge; and, e. a second impression made on the second end of the tool body, the second impression substantially matching a shape of a second cartridge drum axle end, the second cartridge drum axle end being different in shape from the first cartridge drum axle end, wherein when the second cartridge drum axle end is inserted within the second impression, the tool allows the drum to be rotated while the drum is within the printer cartridge during manufacturing or remanufacturing of the printer cartridge.

2. The tool of claim 1, wherein the first impression is made on the first end by cutting a piece of the first end according to the predetermined shape of the first cartridge drum axle end.

3. The tool of claim 1, wherein the second impression is made on the second end by cutting a piece of the second end according to the shape of the second cartridge drum axle end.

4. The tool of clam 1, wherein the first impression comprises a triangle.

5. The tool of clam 1, wherein the second impression comprises a triangle.

6. A tool for rotating a drum of a printer cartridge, the drum being housed in a printer and the tool being separate from the printer and not being housed in the printer, the tool comprising:

a. a structure means for providing structure to the tool, the structure means defining a first end and a second end positioned at an end opposite to the first end;

b. a holding means for holding a first type of a cartridge drum axle end, the holding means being positioned on the first end, wherein when the first type of cartridge drum axle end is positioned within the holding means, the structure means may be rotated to rotate the drum of the printer cartridge while the drum is within the printer cartridge; and, c. a second holding means for holding a cartridge drum axle end, the second holding means being positioned on the second end, the second holding means being configured to hold a second type of cartridge drum axle end, wherein when the second type of cartridge drum axle end is positioned within the second holding means, the structure means may be rotated to rotate the drum of the printer cartridge while the drum is within the printer cartridge during manufacturing or remanufacturing of the printer cartridge.

7. A method of assembling a printer cartridge drum, the printer cartridge drum having an axle connected to a printer drum driving mechanism, the axle being connected to a printer cartridge at an axle end, the printer cartridge drum being housed in a printer, the method comprising:

a. providing a tool configured to hold the axle end, the tool being separate from the printer and not being housed in the printer;

b. allowing the tool to hold the axle end;

c. rotating the tool to rotate the drum while the drum is within the printer cartridge;

d. providing a second printer cartridge drum, the second printer cartridge drum having an axle end that is different from the axle end of the first printer cartridge drum;

e. positioning the tool around the axle end of the second printer cartridge drum; and, f. rotating the tool to rotate the drum while the drum is within the printer cartridge, wherein the rotation of the tool rotates the second printer cartridge drum while the second printer cartridge drum is within the printer cartridge.

* * * * *